US006478012B2

(12) United States Patent
Bender

(10) Patent No.: US 6,478,012 B2
(45) Date of Patent: Nov. 12, 2002

(54) THROTTLE-VALVE ACTUATOR

(75) Inventor: Günther Bender, Rodheim (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/833,265

(22) Filed: Apr. 10, 2001

(65) Prior Publication Data

US 2001/0056008 A1 Dec. 27, 2001

(30) Foreign Application Priority Data

Apr. 18, 2000 (DE) ..... 100 19 117

(51) Int. Cl.[7] ..... F02D 9/08
(52) U.S. Cl. ..... 123/399; 123/361
(58) Field of Search ..... 123/399, 361

(56) References Cited

U.S. PATENT DOCUMENTS 5,415,144 A * 5/1995 Hardin et al. ..... 123/399
6,000,377 A * 12/1999 Sato et al. ..... 123/337
6,047,680 A * 4/2000 Shimura et al. ..... 123/336
6,279,535 B1 * 8/2001 Matsusaka ..... 123/399
6,371,080 B1 * 4/2002 Saito et al. ..... 123/337

FOREIGN PATENT DOCUMENTS

| | | | | |
|---|---|---|---|---|
| DE | 19525510 | | 1/1997 | |
| DE | 19540323 | | 4/1997 | |
| DE | 19628379 | | 1/1998 | |
| JP | 32588 | * | 2/1997 | ..... F02D/9/02 |

* cited by examiner

*Primary Examiner*—Tony M. Argenbright
*Assistant Examiner*—Hai H. Huynh
(74) *Attorney, Agent, or Firm*—Martin A. Farber

(57) ABSTRACT

To connect a potentiometer (2) and a brush holder (1) of a servomotor of a throttle-valve actuator for a motor-vehicle engine with actuating electronics, use is made of a conductor bridge (3). This has supports (8, 9), by which it is supported in the throttle-valve actuator. The conductor bridge (3) is furthermore provided with two rigid conductor bars (4,5) for supplying energy to the servomotor and conductors for making contact with conductor tracks (21–24) of the potentiometer. The two conductor bars (4, 5) and the conductors are each connected to a plug pin (11–16) of a plug socket (10) of the conductor bridge (3).

9 Claims, 2 Drawing Sheets

THROTTLE-VALVE ACTUATOR

FIELD AND BACKGROUND OF THE INVENTION

The invention relates to a throttle-valve actuator for a motor-vehicle engine, which has a servomotor to be supplied with electrical energy and, spatially separate from the latter, a potentiometer for determining the position of a shaft of the throttle valve.

Throttle-valve actuators of the abovementioned type are fitted to modern motor vehicles with so-called electronic accelerators and are therefore known. With these, adjustment of the power output is no longer effected by means of a mechanical link between the accelerator pedal and the throttle valve but by means of electrical actuating commands as a function of the position of the accelerator pedal. Here, a wiring harness leads into the throttle-valve actuator to connect the potentiometer to the actuating electronics and to connect the servomotor to electrical energy controlled by the actuating electronics. The problem with such electrical connections by means of cables is that breaks in the cables can occur relatively easily owing to vibration build-up in natural resonance. Often, there is also the risk, during assembly, that cables will be trapped between a housing and a cover to be placed on the latter. In the case of plug connections within devices, contact fretting (frictional oxidation) occurs due to movements in the area of the electrical connections and due to the effects of temperature.

SUMMARY OF THE INVENTION

The problem underlying the invention is to design a throttle-valve actuator of the type stated at the outset in such a way that its required electrical connections are as simple as possible but as insensitive as possible to vibration and to the high temperatures that occur in a motor vehicle.

According to the invention, this problem is solved by virtue of the fact that the throttle-valve actuator has a conductor bridge, which is supported firmly in the throttle-valve actuator by supports and has two rigid conductor bars for supplying energy to the servomotor and conductors for making contact with conductor tracks of the potentiometer, and that the two conductor bars and the conductors are each connected to a plug pin of a plug socket of the conductor bridge.

By virtue of this conductor bridge according to the invention, which is supported in the throttle-valve actuator, the power is distributed via a rigid component which has no tendency for vibration and with which no forces are introduced into the electrical connections to the potentiometer and the servomotor when plugging in or unplugging the plug for connection to the actuating electronics. Moreover, the conductor bridge makes it unnecessary to lay individual cables in the throttle-valve actuator and to make individual electrical connections. As a result, there is less effort involved in assembly and the space required for such cables can be saved. Moreover, the invention ensures that it is impossible for electric leads to be trapped when placing a cover on the housing of the throttle-valve actuator. The conductor bridge according to the invention could even be used as a support for additional components, e.g. for an interference suppression coil, bleed resistors, carbon motor brushes with pigtail leads and the like. A predetermined breaking point provided in the plastic could be used to allow tolerances to be compensated for by breaking off the conductor track sections that would then be exposed.

The configuration of the conductor bridge is particularly simple in terms of design if the conductor bars connect two plastic bodies, which are produced by injection moulding in an injection mould and each have one of the supports.

The conductor bridge can be produced with its two plastic bodies in a single operation by injection moulding if, according to another development of the invention, the conductor bars together with the conductors and the plug pins are designed as an insert that can be inserted into an injection mould and can there be encapsulated to give the plastic bodies at the ends.

The insert can be designed as a single one-piece component for insertion into the injection mould if in the region of the plastic bodies it has between the conductor bars and the conductors connecting webs that can be removed after injection moulding by means of punch cuts.

Contact corrosion due to relative motion between the connecting lugs of the contact bridge and the conductor tracks of the potentiometer can be completely eliminated if the conductors are seated by means of flexible connecting lugs on the conductor tracks of the potentiometer and are connected to these by a respective laser weld.

Electrical conductors can be protected very effectively from corrosion and have a high electrical conduction capacity if they are covered with a high-gloss layer of metal, in particular if they are gold- or silver-plated. However, such coatings have a high reflectivity, necessitating a high power for laser welding. However, this has the disadvantage that holes can very easily be formed by the laser beam in the material to be welded, resulting in failure to form a welded joint. Difficulties in laser welding due to excessive reflectivity can be avoided, even if the insert is completely covered with an electrically conductive high-gloss layer of metal, if the connecting lugs have a rough surface produced by stamping in the region of the laser weld. This prevents undesirably high reflection of the laser light.

The insert has a particularly good electrical conductivity and particularly low contact resistance and overall has particularly little tendency to corrosion if it is completely covered with silver.

Contact can be made with the servomotor simply by pushing on the conductor bridge without there being a risk of contact fretting if, according to another development of the invention, the conductor bars end with two contact posts in the plastic body associated with the servomotor, and the servomotor has two contact lugs, which rest at an acute angle against these contact posts and allow insulation displacement connection.

The throttle-valve actuator can also be designed in such a way that there is no need for any plug connections within its housing if the plug pins are arranged in an outer connector socket projecting in a sealed manner from the throttle-valve actuator.

BRIEF DESCRIPTION OF THE DRAWINGS

The invention admits of various embodiments. To further illustrate their basic principle, one of these is illustrated in the drawing and described below. In the drawing.

DETAILED DESCRIPTION OF THE PREFERRED EMBODIMENT

Figure 1:
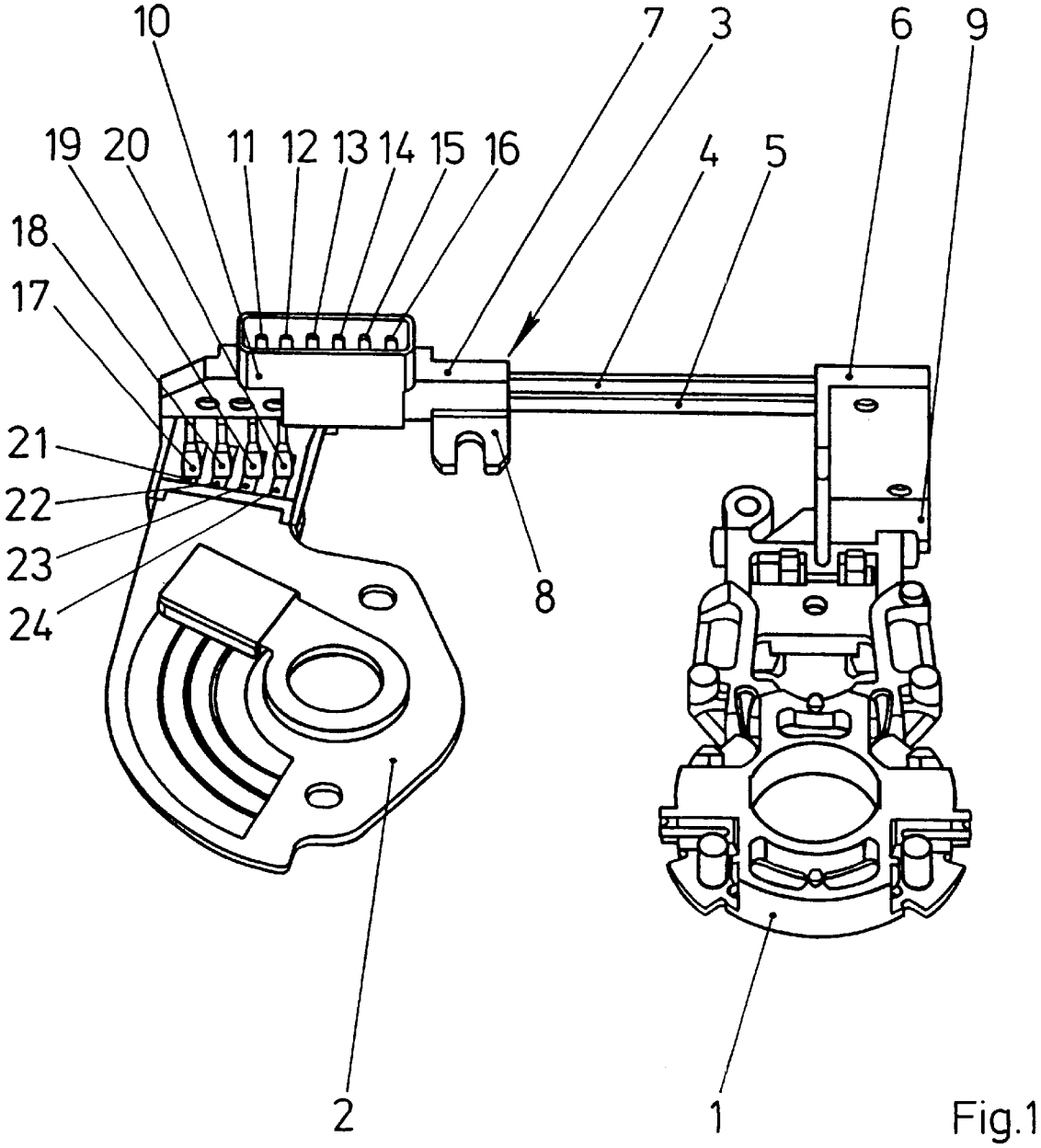
FIG. 1 shows a perspective view of built-in components of a throttle-valve actuator with a conductor bridge according to the invention.

Of a servomotor, FIG. 1 shows a brush holder 1 and adjacent to the latter, with a spacing in between, a potentiometer 2, which is used to pick off the position of a throttle valve shaft. A conductor bridge 3 is used to connect these components electrically. This bridge has two conductor bars 4, 5, which are each encapsulated at their ends with a plastic body 6, 7 common to the two conductor bars 4, 5. At their lower end, both plastic bodies 6, 7 have a support 8, 9, by means of which they are seated and secured in a throttle-valve actuator.

The plastic body 7 has a plug socket 10 with plug pins 11 to 16. The two plug pins 15, 16 on the right-hand side are each connected to one of the conductor bars 4, 5. Flexible connecting lugs 17–20 lead from the plastic body 7 to conductor tracks 21–24 of the potentiometer 2. These connecting lugs 17–20 have been connected to the conductor tracks 21–24 by laser welding, each connecting lug first of all having been provided with stamped features to increase the roughness of its surface.

Figure 2:
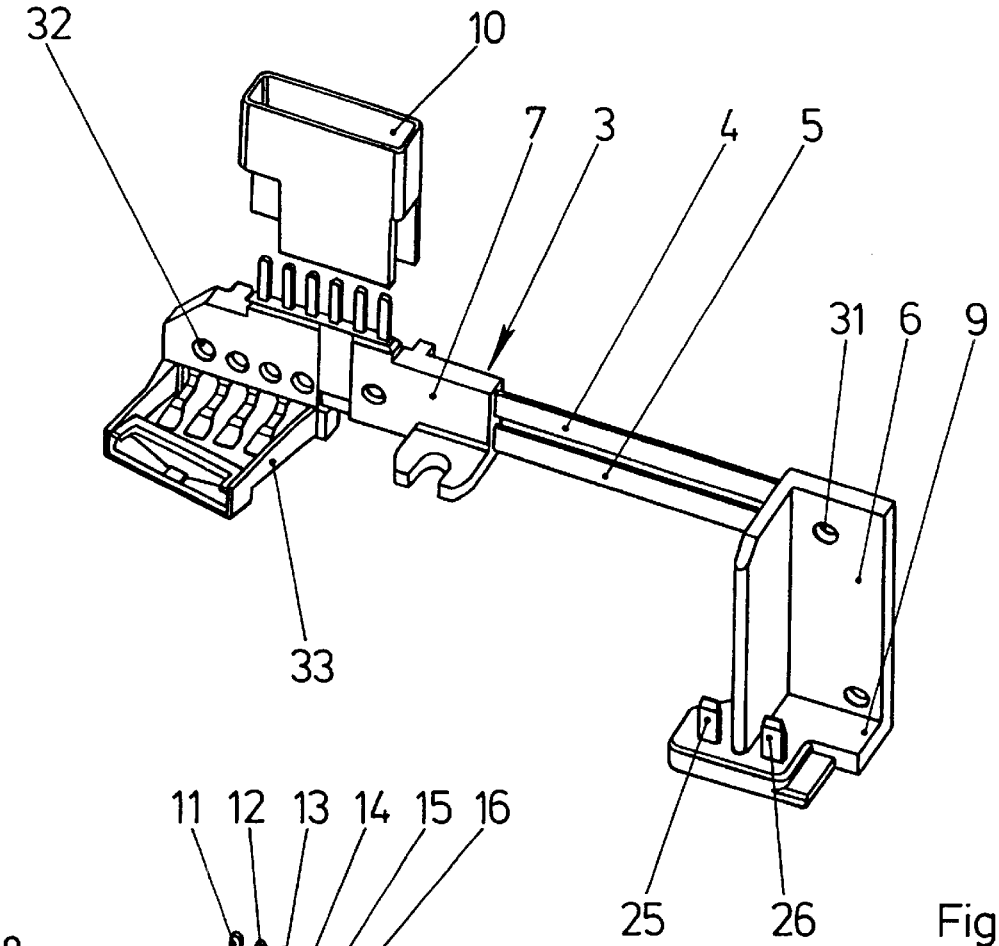
FIG. 2 shows the conductor bridge in perspective view.

FIG. 2 shows the conductor bridge 3 as a separate component. This shows two upward-projecting contact posts 25, 26 in the support 9 of the plastic body 6. Contact post 25 is connected to conductor bar 5, while contact post 26 is connected to conductor bar 4. A contact lug (not shown) of the brush holder 1 rests against each of the contact posts 25, 26 at an acute angle in the assembled condition in such a way that the brush holder 1 can be pushed onto the contact posts 25, 26 from above but the contact lugs jam like barbs if an attempt is made to pull the brush holder 1 off again.

The left-hand part of FIG. 2 shows a socket 33, which is used for component prefixing and is pushed over the corresponding area of the potentiometer 2 during assembly.

Figure 3:
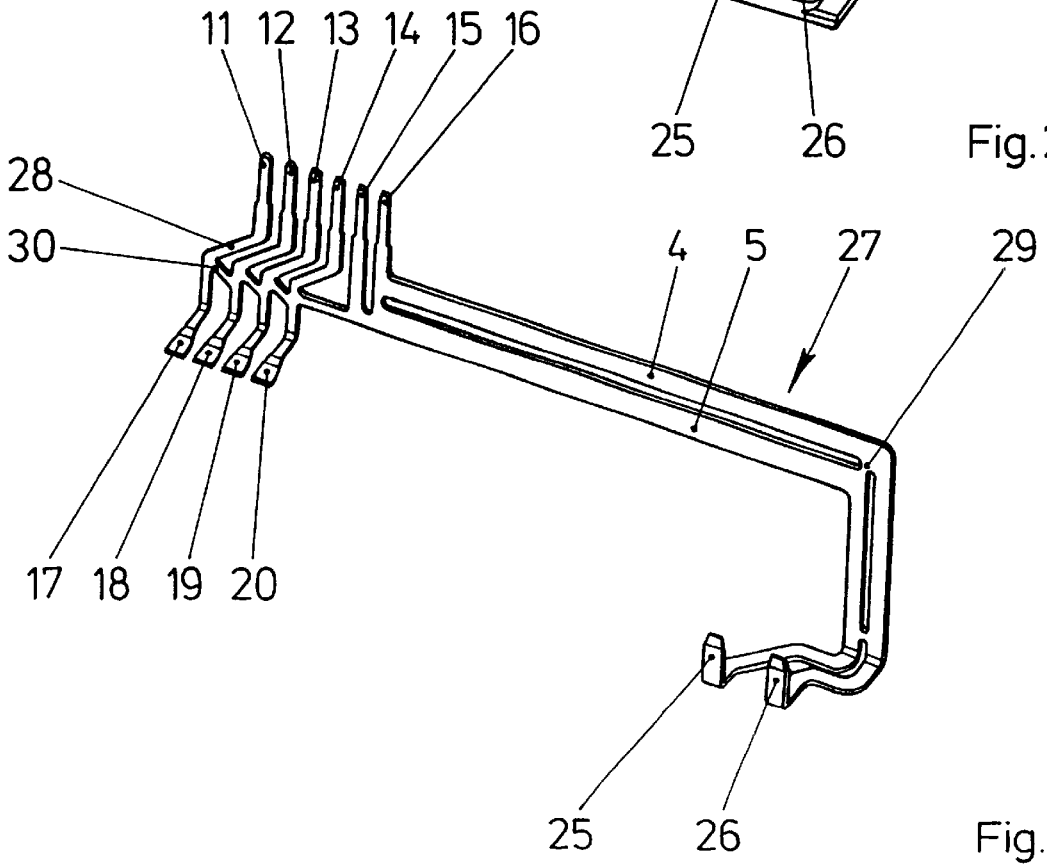
FIG. 3 shows a built-in component of the conductor bridge in perspective view.

FIG. 3 shows an insert 27, which has the conductor bars 4, 5 with the contact posts 25, 26, the plug pins 11–16 and the connecting lugs 17–20. Each of the connecting lugs 17–20 is connected electrically to one of the plug pins 11–15 by a conductor 28. To ensure that the insert 27 is initially a unified one-piece component, the conductor bars 4, 5 and the conductors 28 are connected to one another by connecting webs 29, 30, for example. In FIG. 2 explained above, punch cuts 31, 32 can be seen at the corresponding points.

To produce the conductor bridge 3, the insert 27 shown in FIG. 3 is placed in an injection mould and the plastic bodies 6 and 7 are then moulded in a single operation. The part produced is then removed from the injection mould and the punch cuts 31, 32 are produced in a separate operation, thereby severing the connecting webs 29, 30 and therefore giving rise to electrically separate current paths.

I claim:

1. Throttle-valve actuator for a motor-vehicle engine, which has a servomotor to be supplied with electrical energy and, spatially separate from the latter, a potentiometer for determining the position of a shaft of the throttle valve, wherein the throttle-valve actuator has a conductor bridge (3), which is supported firmly in the throttle-valve actuator by supports (8, 9) and has two rigid conductor bars (4, 5) for supplying energy to the servomotor and conductors (28) for making contact with conductor tracks (21–24) of the potentiometer, and the two conductor bars (4, 5) and the conductors (28) are each connected to a plug pin (11–16) of a plug socket (10) of the conductor bridge (3).

2. Throttle-valve actuator according to claim 1, wherein the conductor bars (4, 5) connect two plastic bodies (6, 7), which are produced by injection moulding in an injection mould and each have one of the supports (8, 9).

3. Throttle-valve actuator according to the claim 1, wherein the conductor bars (4, 5) together with the conductors (28) and the plug pins (11–16) are formed as an insert (27) that is insertable into an injection mould and can there be encapsulated to give the plastic bodies (6, 7) at the ends.

4. Throttle-valve actuator according to claim 3, wherein in a region of the plastic bodies (6, 7), the insert (27) has between the conductor bars (4, 5) and the conductors (28) connecting webs (29, 30) that are removable after injection moulding by means of punch cuts (31,32).

5. Throttle-valve actuator according to claim 3, wherein the conductors (28) are seated by means of flexible connecting lugs (17–20) on the conductor tracks (21–24) of the potentiometer (2) and are connected to these by a respective laser weld.

6. Throttle-valve actuator according to claim 5, wherein the insert (27) is completely covered with an electrically conductive high-gloss layer of metal and the connecting lugs (17–20) have a rough surface produced by stamping in the region of the laser weld.

7. Throttle-valve actuator according to claim 6, wherein the insert (27) is completely covered with silver.

8. Throttle-valve actuator according to claim 1, wherein the conductor bars (4, 5) end with two contact posts (25, 26) in a plastic body (6) associated with the servomotor, and the servomotor has two contact lugs, which rest at an acute angle against these contact posts (25, 26) and allow insulation displacement connection.

9. Throttle-valve actuator according to claim 1, wherein the plug pins (11–16) are arranged in an outer connector socket projecting in a sealed manner from the throttle-valve actuator.

* * * * *